US007174842B1

(12) United States Patent
Lin

(10) Patent No.: US 7,174,842 B1
(45) Date of Patent: Feb. 13, 2007

(54) BOAT PROPULSION SYSTEM

(75) Inventor: Hsu Tsang Lin, Tucheng (TW)

(73) Assignee: Liung Feng Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/224,990

(22) Filed: Sep. 14, 2005

(51) Int. Cl.
*B63H 25/46* (2006.01)
*B63H 11/08* (2006.01)
*B63H 11/107* (2006.01)

(52) U.S. Cl. ..... 114/151; 440/38; 440/40

(58) Field of Classification Search ..... 114/144 R, 114/151; 440/38, 39, 40–42; 60/221, 222
See application file for complete search history.

(56) References Cited

U.S. PATENT DOCUMENTS 638,211 A * 12/1899 Boes ..... 440/40
3,209,717 A * 10/1965 Campbell et al. ..... 114/151
3,283,735 A * 11/1966 Sugino ..... 114/151
4,807,552 A * 2/1989 Fowler ..... 114/151
6,394,015 B1 * 5/2002 Gabriel ..... 114/151
6,932,013 B1 * 8/2005 Shen et al. ..... 114/151

* cited by examiner

*Primary Examiner*—Ajay Vasudeva
(74) *Attorney, Agent, or Firm*—Troxell Law Office, PLLC

(57) ABSTRACT

A boat propulsion system includes a plurality of positive displacement pumps which having high discharge head and having inlets and outlets therein and a controlling panel having circuits, wherein the pumps are mounted on a bottom of a boat and driven by a motive power. By means of different positions of the outlets in each pump or different power transmission of each pump and cooperating with using the controlling panel, the boat can therefore move toward desired directions and enhancing power transmission by the pumps are drawn uniform flow when the boat is moved.

8 Claims, 12 Drawing Sheets

BOAT PROPULSION SYSTEM

BACKGROUND OF THE INVENTION

1. Field of the Invention

The present invention relates to a boat propulsion system for being replaceable to a rudder controlling moving direction and enhancing power transmission during the boat is moved.

2. Prior Art

Boat propulsion systems are known as primary power for moving boats. The power can be adjusted to different levels by marine engine in order to control moving speed of a boat, and if cooperate with a rudder, the boat can turn port or starboard.

However, a boat's movement is generally affected by varied reasons such as kinds of propellers, rudders and positions where they are mounted on. Though the propellers and rudders can make the boat move and turn, they still suffer from several drawbacks as described below:

1. unstable power transmission-a propeller is generating vortex by way of rotating blades, and the vortex facilitates the boat move, however, the vortex may affect the power transmission and result in unstable transmission.
2. over-big turning radius-a boat can change its moving directions by utilizing a rudder swinging; the rudder operates based on the "Bernoulli Theory", that is, an equation that relates the fluid pressure and velocity acting along the surface of a wing. It also can apply to a boat's rudder. The rudder is a curved shape while the opposite side is relatively flat. Thus, when fluid passes over the rudder, that stream over the curved side is squeezed into a smaller area than that stream passing the relatively flat side. Thus, a higher pressure exists on the relatively flat surface of the rudder and a lower pressure on the curved surface. As the hydraulic pressure difference generated between the two surfaces of the rudder, a boat can turn according to variation of an angle given by the rudder swinging. However, such a turning of boat requires relatively big radius, and it causes the boat cannot turn flexibility.
3. more time to make a turn-as described above, a big turning radius, of course, requires more time to complete the process of turning.

SUMMARY OF THE INVENTION

Accordingly, an object of the present invention is to provide a boat propulsion system having a plurality of positive displacement pumps for generating uniform jet-flow of fluid as the thrust power source and thus can enhance power transmission efficiency and stability.

Another object of the present invention is to provide a boat propulsion system for controlling moving direction and requiring smaller radius and being able to replace a conventional rudder.

To achieve the above object, a boat propulsion system in accordance with the present invention includes a plurality of positive displacement pumps which having high discharge head and having inlets and outlets therein and a controlling panel having circuits, wherein the pumps are mounted on the bottom of a boat and driven by a motive power. By means of different positions of the outlets in each pump and different arrangement of each pump and cooperating with using the controlling panel, the boat can therefore move toward desired directions.

Other objects, advantages and novel features of the present invention will be drawn from the following detailed embodiment of the present invention with the drawings.

DESCRIPTION OF THE PREFERRED EMBODIMENT

Figure 1:
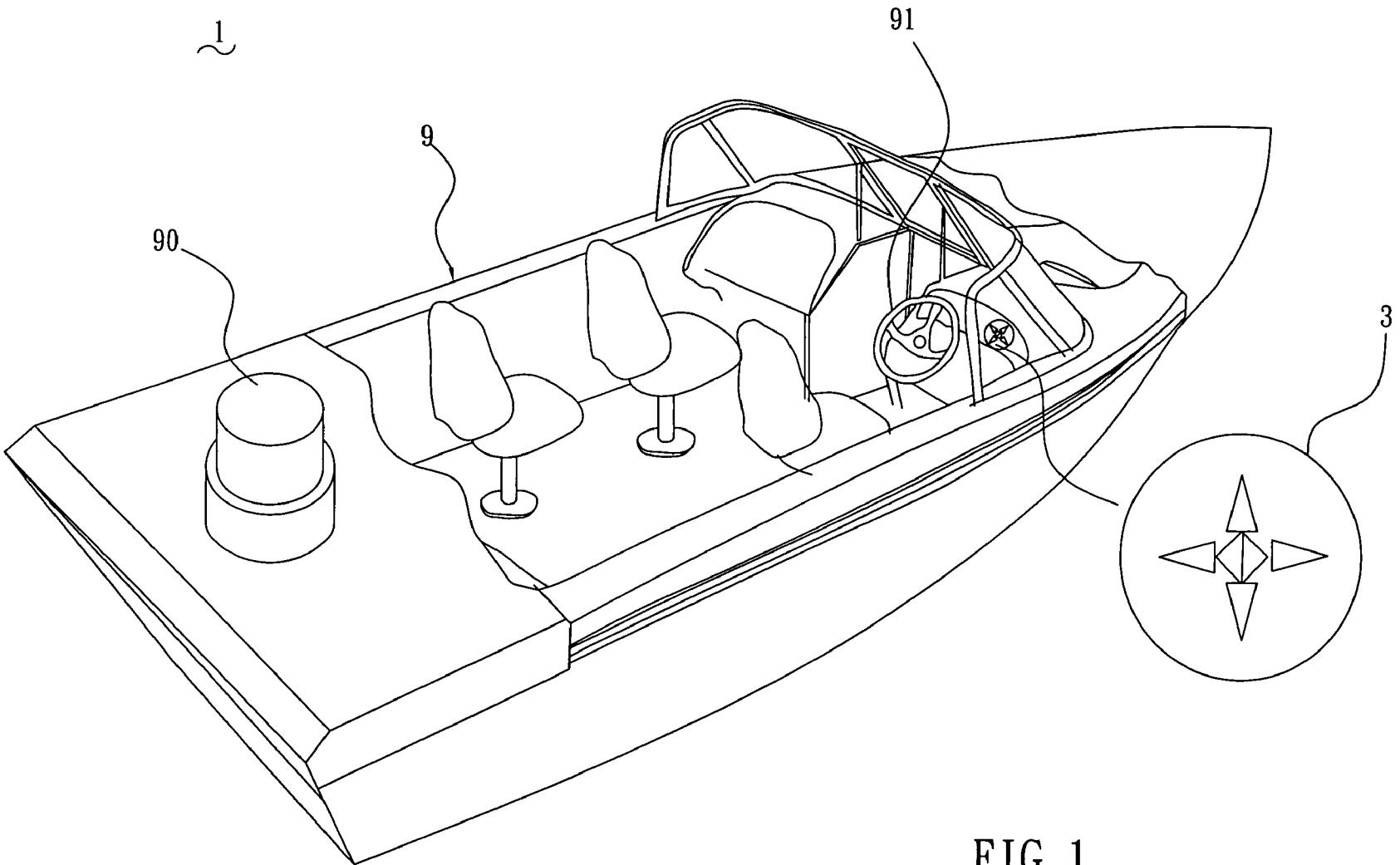
FIG. 1 is an perspective view of a boat propulsion system in accordance with a preferred embodiment of the present invention, and the boat propulsion system is mounted on a boat.

Referring to FIGS. 1 to 5, a boat propulsion system 1 in accordance with the first embodiment of the present invention comprises: a plurality of positive displacement pumps 2 mounted on a bottom of a boat 9, a controlling panel 3, and a transmission apparatus 4. Referring to FIG. 1, a motive power 90 of the boat 9 is disposed at the rear of the boat, and the controlling panel 3 is set nearby a steering wheel 91 having circuits therein (not shown) for switching on or off each pump 2. The controlling panel 3 further has controlling buttons with signs, shapes or descriptions for different functions such as forward button 30, backward button 31, turning left button 32, turning right button 33, and turning around button 34, 35.

Figure 3:
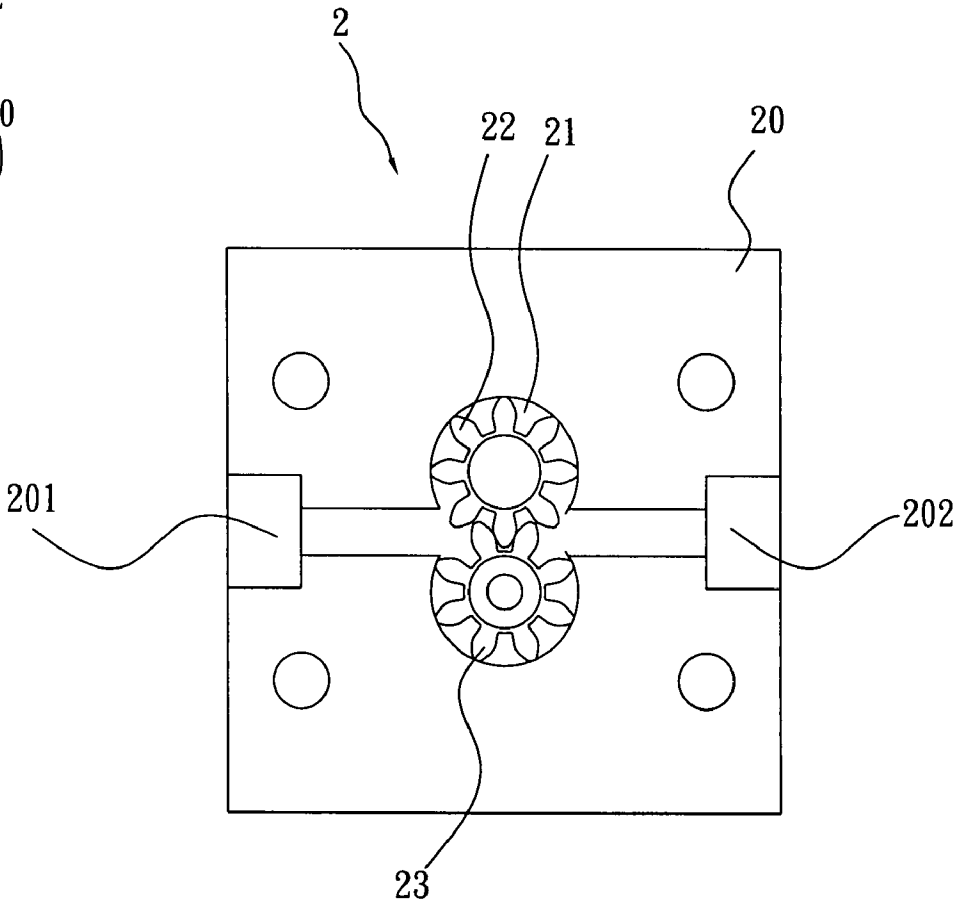
FIGS. 2 and 3 are schematic views of two types of pumps.
Figure 2:
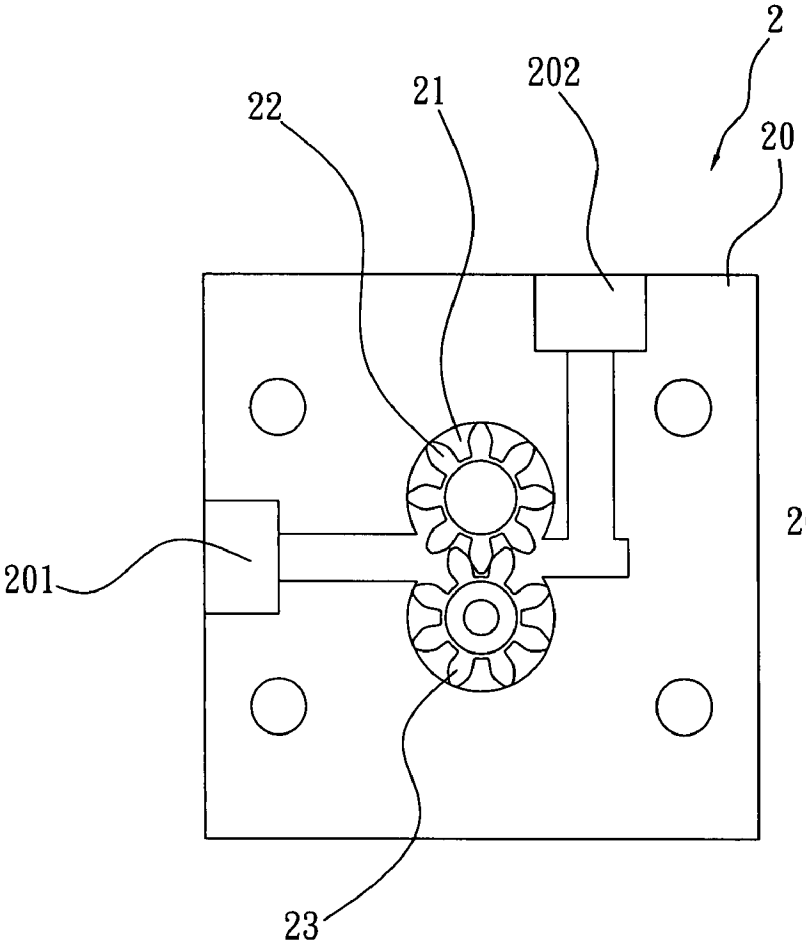

Referring to FIGS. 2 and 3, the pumps 2 are driven by the motive power 90. Each pump 2 comprises a housing 20 having a driving chamber 21, an inlet 201 and an outlet 202 therein, both the inlet 201 and outlet 202 communicating with the driving chamber 21. A first gear rotor 22 and a second gear rotor 23 are assembled in the driving chamber 21 and are engaged with each other. In FIG. 2, the inlet 201 is positioned perpendicularly to the outlet 202, whereas in FIG. 3, the inlet 201 is positioned horizontally to the outlet 202 with opposite direction. By way of different positions of the outlets 202 in each pump 2 and cooperate with different arrangement of each pump 2 in order to make the boat 9 move or turn, and thus the boat 9 turns requiring smaller radius. A remarkably feature is that through a full compression by the first and the second gear rotor 22, 23, a flow of the fluid is in a positive displacement and is pressurized by the first and the second gear 22, 23 whereby the pump 2 generates high discharge head and therefore efficiently transports the fluid. Furthermore, the flow of the fluid generated by the pumps 2 turns to a jet-flow that the liquid is discharged uniformly during the meshing rotation of the first and second gears and thus can prevent from generating unnecessary vortex to affect the boat 9 thereby can reduce a loss of the power transmission.

Figure 4:
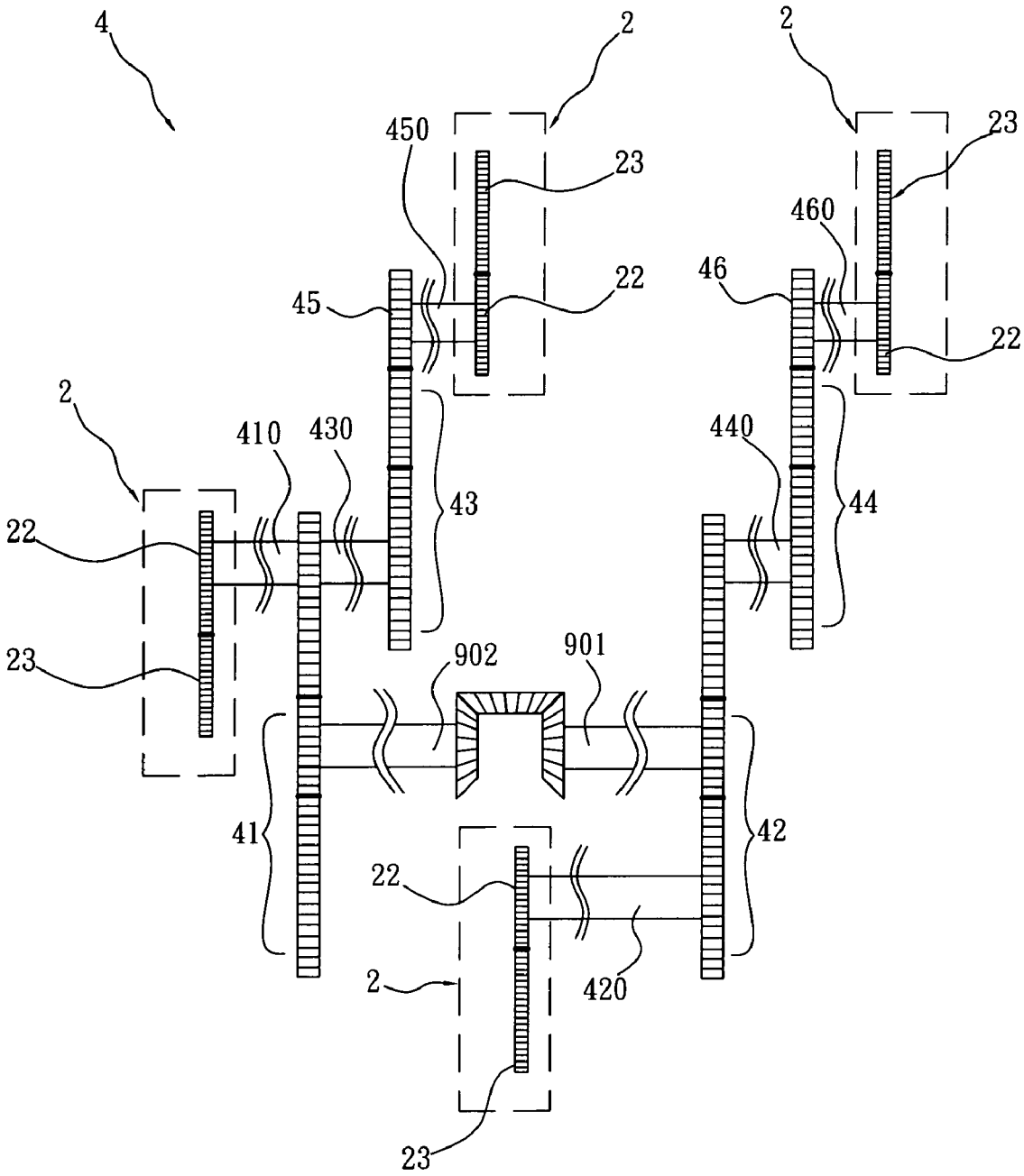
FIG. 4 is a plan view of a transmission apparatus being pivotally connected with the pumps.
Figure 5:
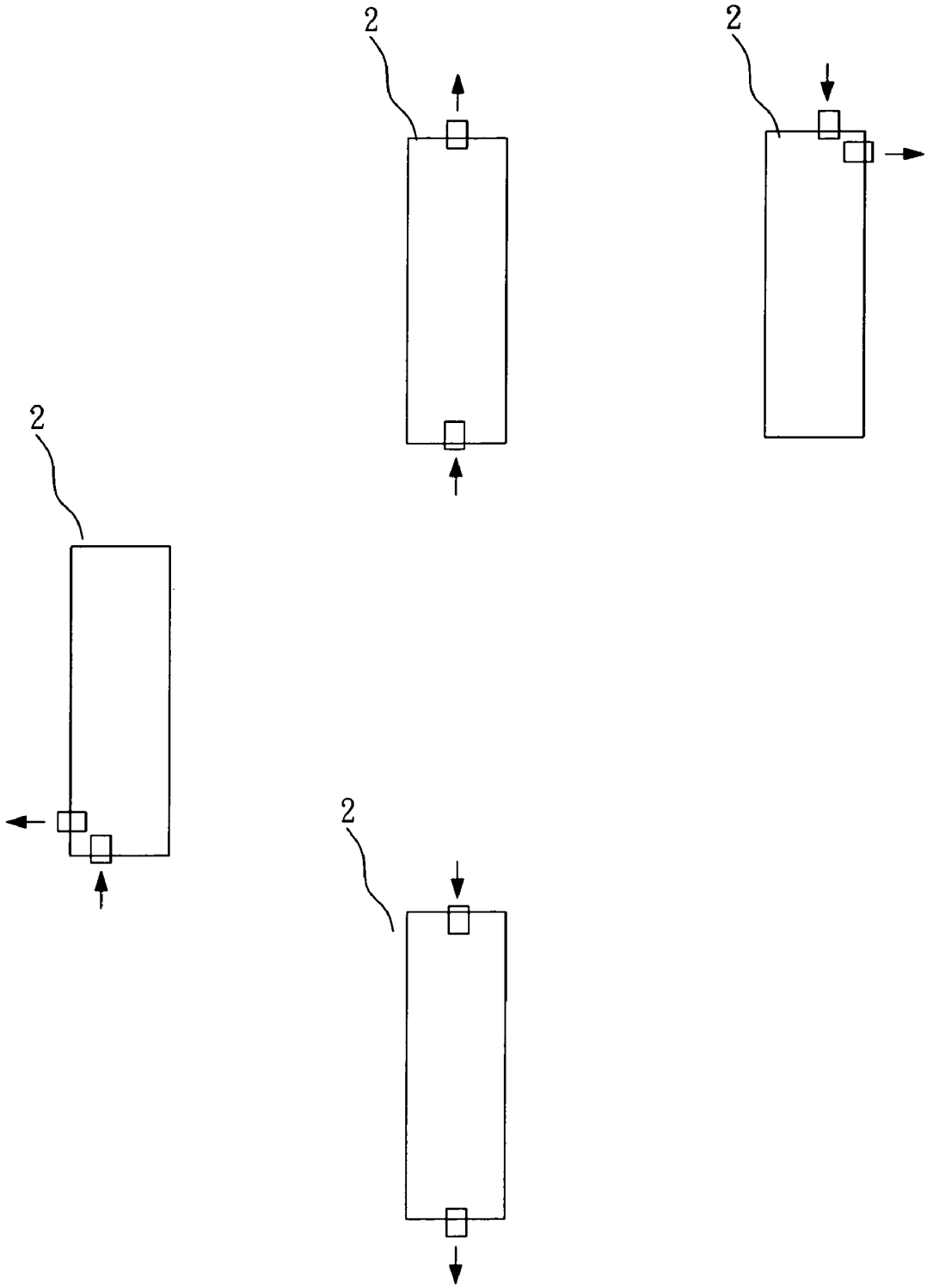
FIG. 5 is a plan view of a layout of inlets and outlets of the pumps.
Figure 6:
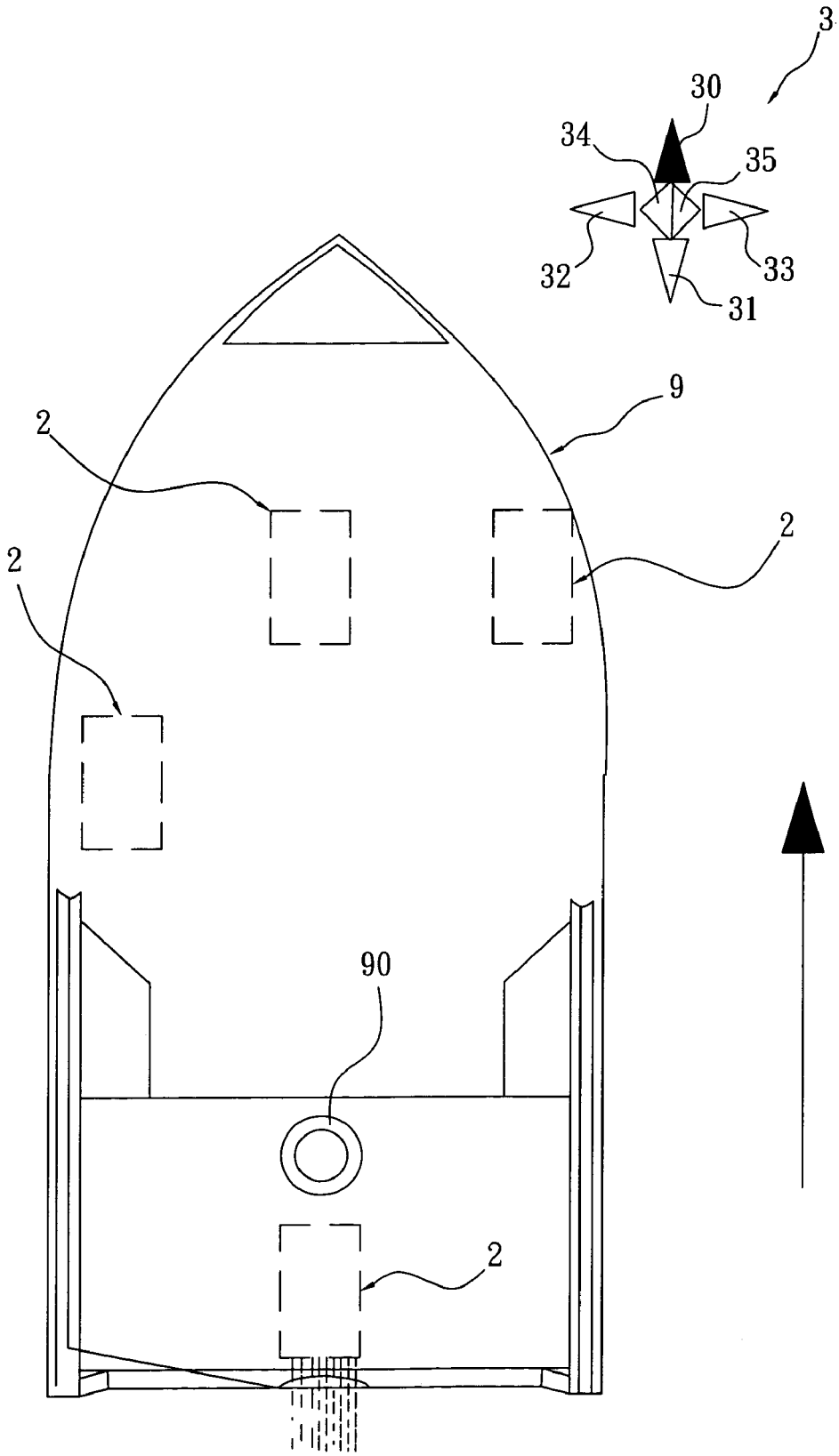
FIGS. 6-10 are schematic views illustrating the boat moving forwardly, turning right, turning left, moving backwardly and turning round.
Figure 7:
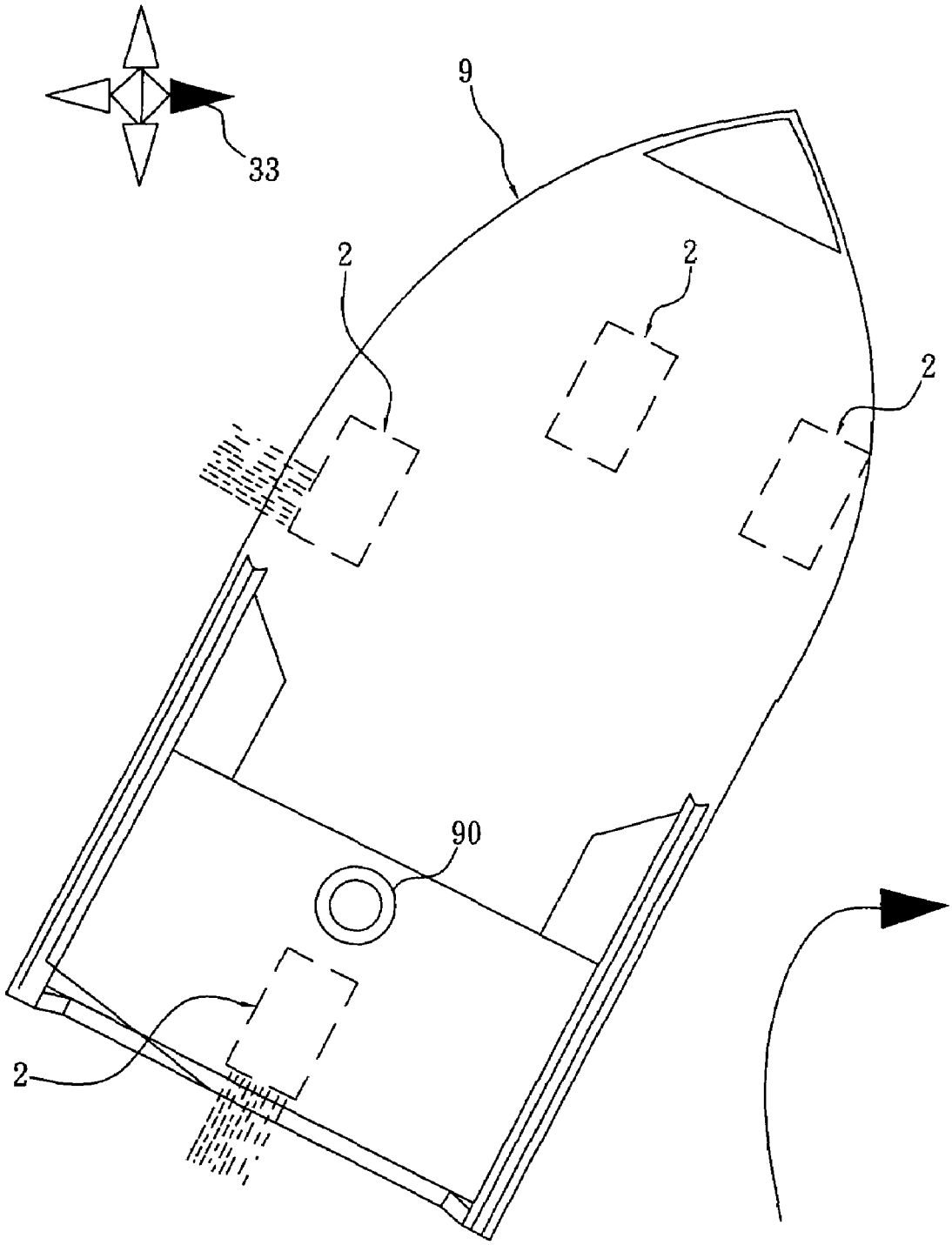

Referring to FIG. 4, the transmission apparatus 4 is driven by the motive power 90 and pivotally connected to each of the pumps 2 for transmitting power at a steady speed or a discrepant speed in order to drive each of the pumps to generate the thrust of the boat 9. The transmission apparatus 4 includes a bevel gear set 40 and four gear sets 41, 42, 43, 44, wherein the bevel gear set 40 is pivotally mounted to the motive power 90 and driven by the motive power 90. The bevel gear set 40 is further coupled with two driving shafts 901, 902 respectively at different sides thereof for transmitting the power to each of the four gear sets 41, 42, 43, 44. Each gear set 41, 42, 43, 44 is respectively coupled with driven spindles 410, 420, 430, 440 in series. The driven spindles 410, 420, 430, 440 are respectively connected to the first gear rotor 22 of each pump 2 thereby to drive the second gear rotor 23 as the first gear rotor 22 is rotating. Therefore, the transmission apparatus 4 can transmit the power from the motive power 90 to far portions of the boat 9 and cooperate with the controlling panel 3 can drive each pump 2 optionally. Alternatively, the transmission apparatus 4 of the present invention is adoptable with different assembly, by way of example, it can cooperate with clutch or add a gear sets to change the direction of transmission, or add a motive power or other power plant to increase the transmission.

Figure 8:
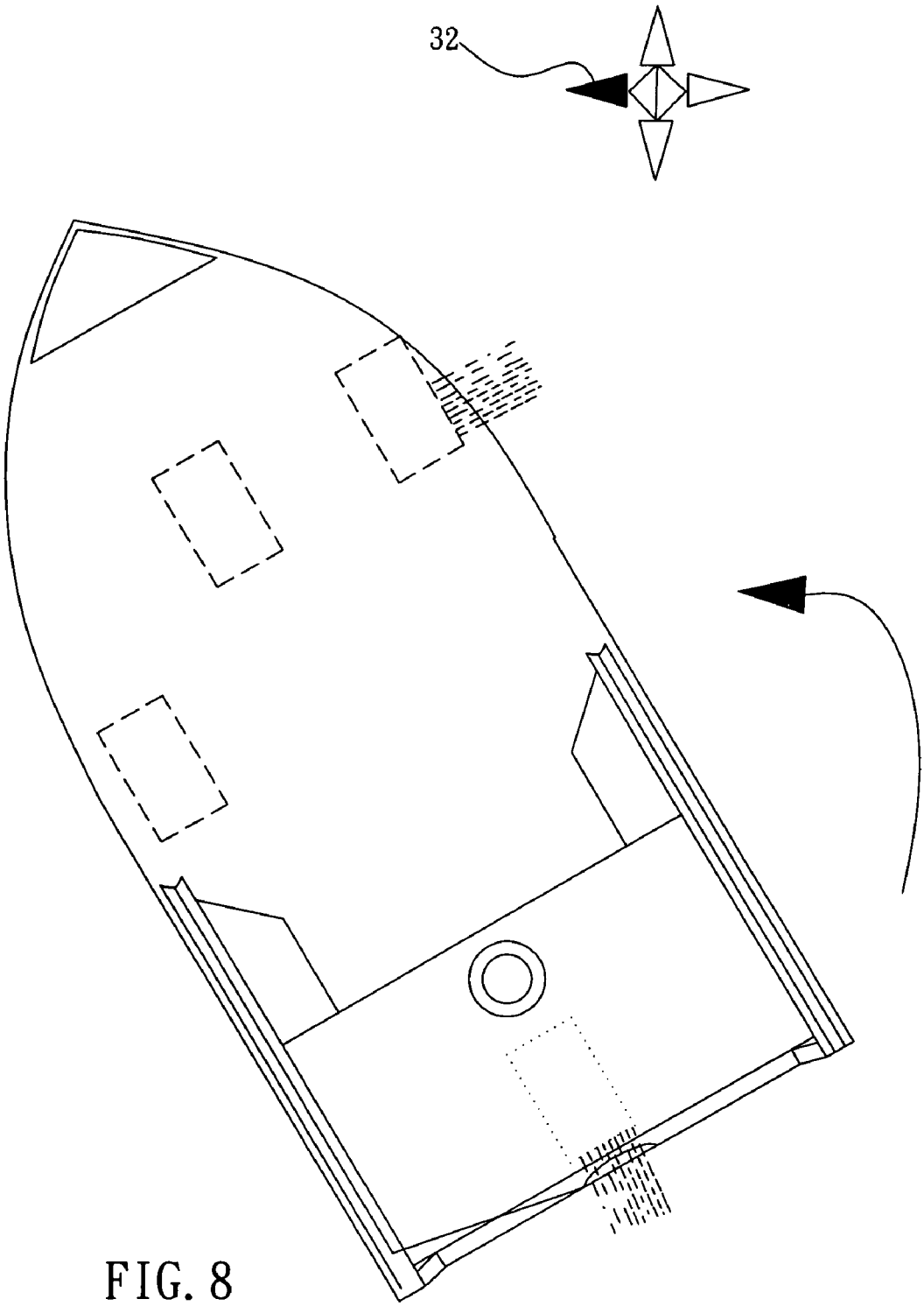
Figure 9:
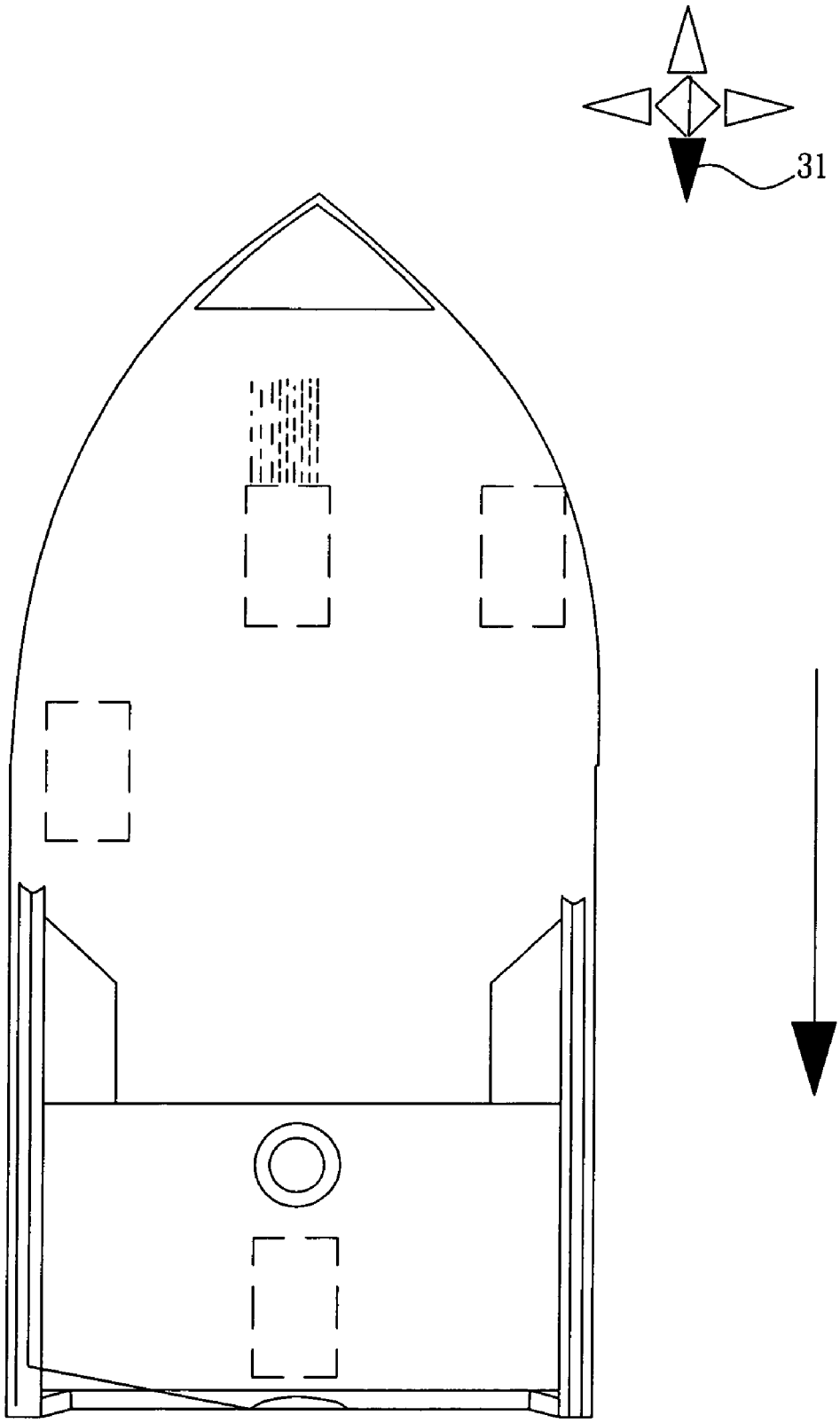
Figure 10:
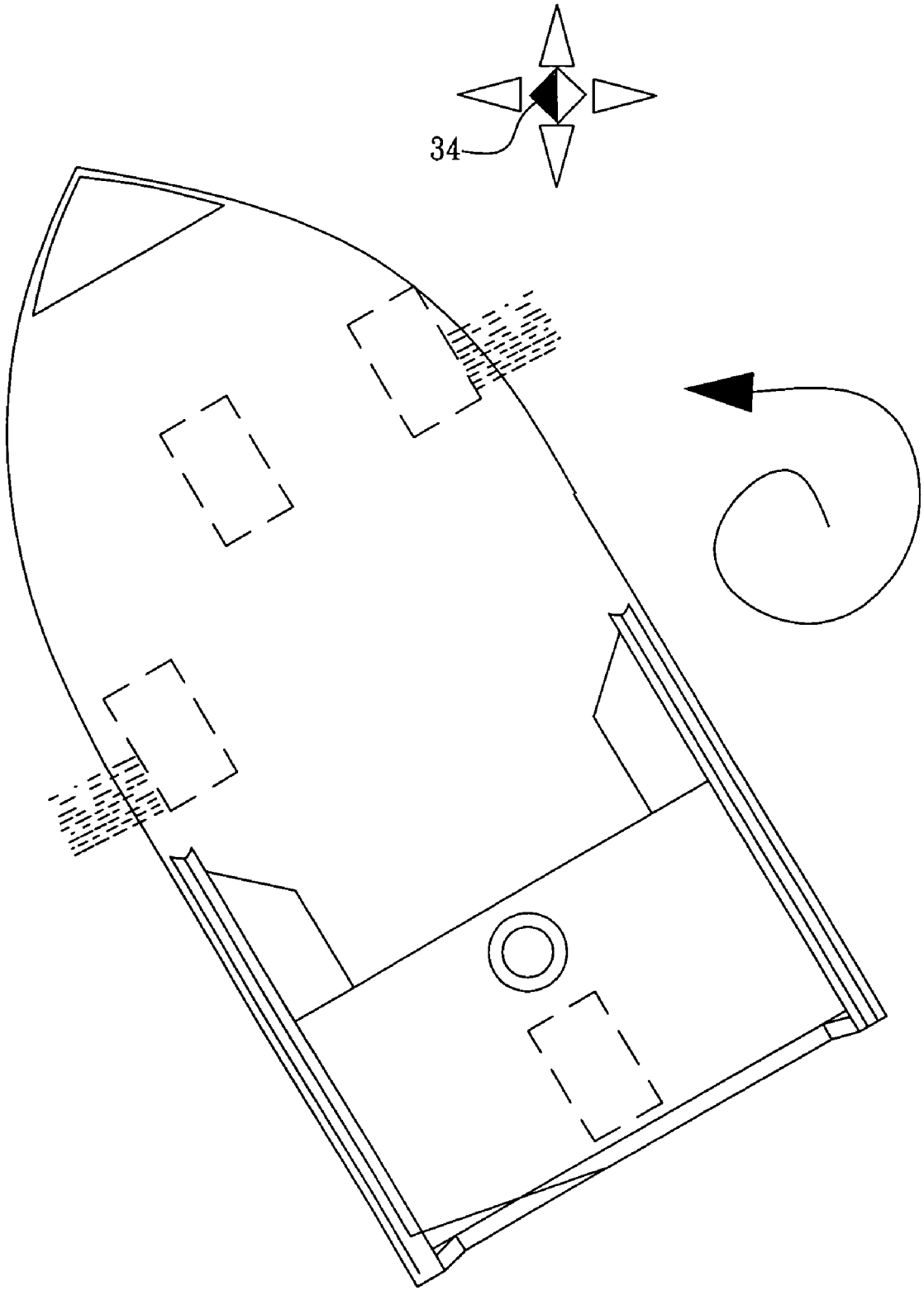

Referring to FIGS. 5 to 10, the four pumps 2 are mounted on a bottom of the boat 9, wherein two of the pumps are mounted respectively on the fore part and the aft part of the boat 9, which are equipped with the inlet 201 and the outlet 202 being horizontal to each other, wherein the outlet 202 of the fore pump 201 is positioned toward the front side of the boat 9 whereas the outlet 202 of the aft pump 201 is positioned toward the stern side of the boat 9. The rest of the two pumps 201 are mounted respectively on the left and the right side of the boat 9 and both are equipped with the inlet 201 and the outlet 202 being perpendicular to each other. The left pump 201 is positioned close to a mid-part of the boat 9 (preferably positioned over the mid-part of the boat 9 for turning quickly). With respect to FIGS. 6 to 10 is shown the boat 9 can move in different directions only by pressing the forward button 30, the backward button 31, the turning left button 32, the turning right button 33 or the turning around button 34, 35. For example, a user can press the forward button 30 for moving forwardly, or press the forward button 30 and the turning left button 32 for turning the boat 9 (as shown in FIG. 8).

Figure 11:
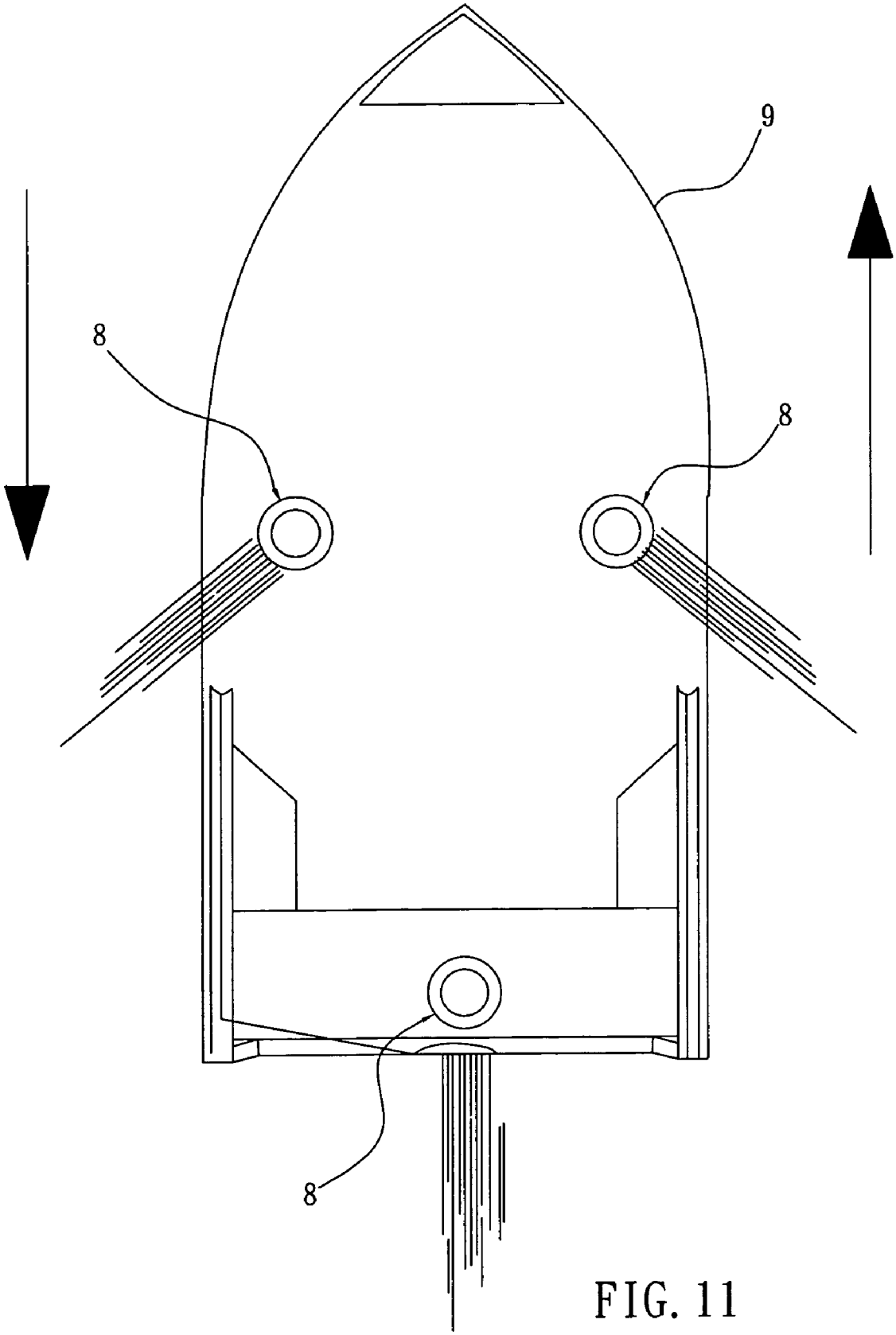
FIGS. 11-13 are schematic views of another embodiment illustrating the boat moving forwardly, turning right, turning left, moving backwardly.
Figure 12:
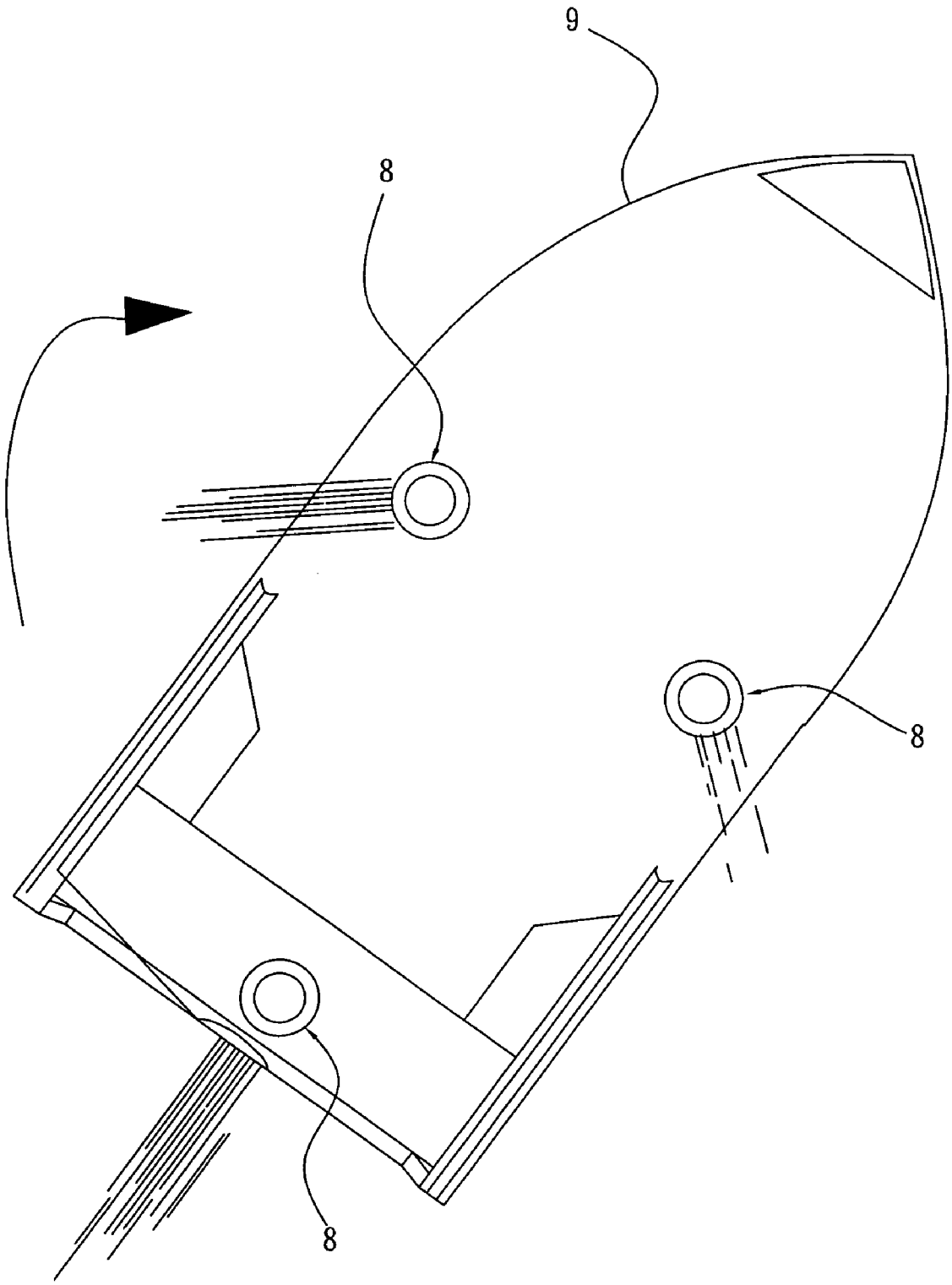
Figure 13:
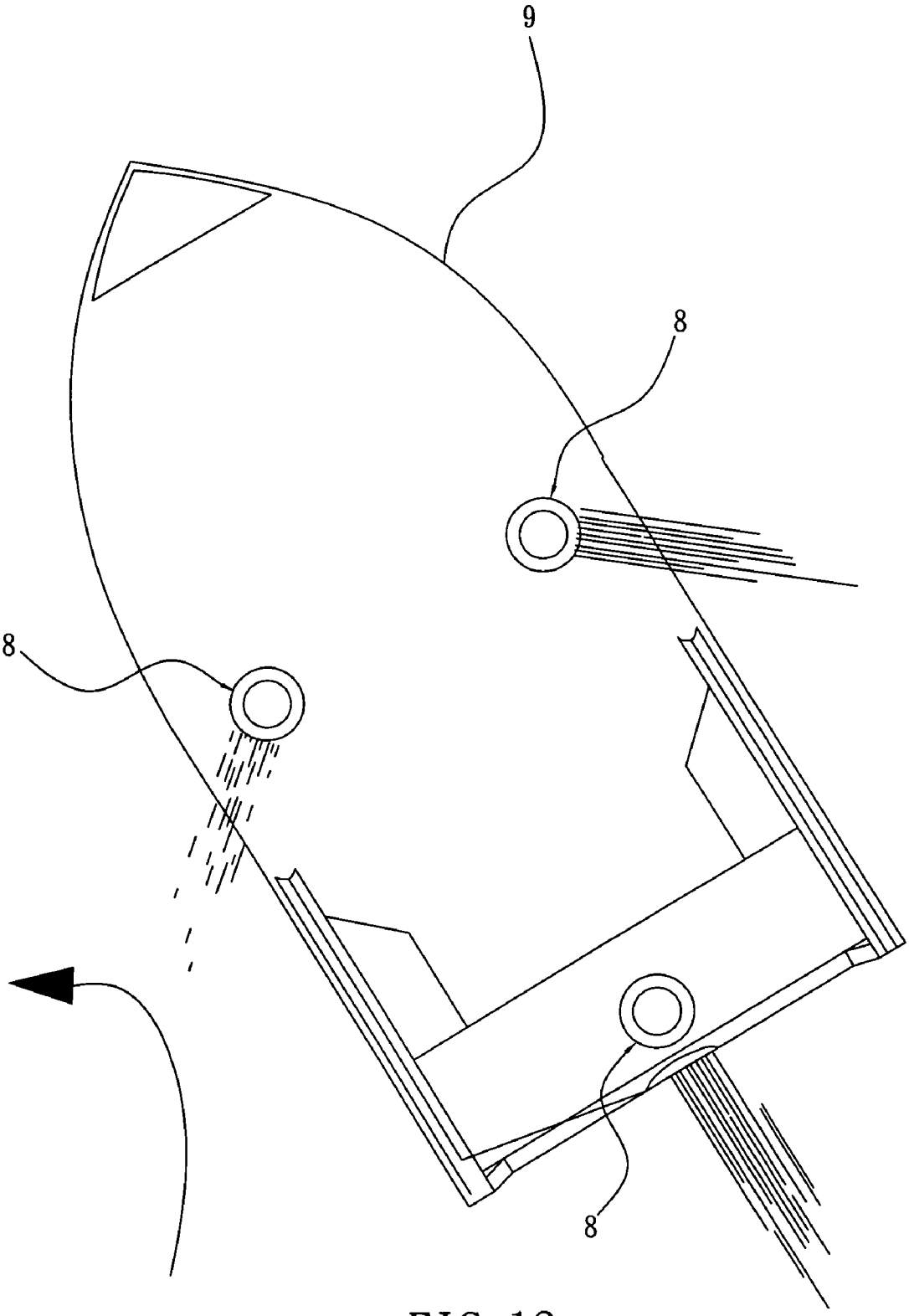

Referring to FIGS. 11 to 13, an alternate embodiment of a boat propulsion system 1 is illustrated, a boat 9 having three driving motors 8 (replaceable by other motive power) which drive three pumps respectively (not shown). The three driving motors 8 are arranged in a triangular position. The pumps mounted on the left and the right sides of the boat are close to mid-part of the boat and outlets of the two pumps are positioned respectively toward the left and the right side. The other pump is mounted aft and an outlet thereof is positioned at a stem side of the boat. By way of controlling the rotation speed and rotation direction of each of the motors 8 through a controlling panel and cooperate with multiple inlets and outlets which are positioned at different directions, the boat can move and turn under controlling. With further reference to FIG. 11 illustrates the boat moving forwardly or backwardly; FIG. 12 illustrates the boat turning rightward; FIG. 13 illustrates the boat turning leftward.

While the preferred embodiment of the invention has been set forth for the purpose of disclosure, modifications of the disclosed embodiment of the invention as -well as other embodiments thereof may occur to those skilled in the art. Accordingly, the appended claims are intended to cover all embodiments which do not depart from the spirit and scope of the invention.

What is claimed is:

1. A boat propulsion system mounted on a boat and being replaceable to a rudder, comprising:

a plurality of positive displacement pumps having a high discharge head and mounted on a bottom of the boat and driven by a motive power, each pump comprising a housing having a driving chamber, an inlet and an outlet, wherein a first gear rotor and a second gear rotor which are assembled in the driving chamber and being engaged with each other, each outlet of the pumps disposed on different positions according to moving directions of the boat; and a controlling panel set on the boat having circuits for switching on or off each pump, further comprises a transmission apparatus driven by the motive power and pivotally connected to each of the pumps for transmitting a supplied power at a steady speed or a discrepant speed in order to drive each of the pumps.

2. the boat propulsion system as claimed in claim 1, wherein the transmission apparatus includes:

a bevel gear set being pivotally mounted to the motive power and coupling with two driving shafts respectively at different sides thereof;

at least two gear sets respectively and pivotally connected with the two driving shafts, wherein each gear set coupling with a driven spindle connecting to one of the first and the second gear rotor of the pumps.

3. The boat propulsion system as claimed in claim 2, wherein the transmission apparatus further comprises a clutch assembled on the driving shaft of the bevel gear set.

4. The boat propulsion system as claimed in claim 3, wherein the gear sets include four sets pivotally and respectively connected with the positive displacement pumps by the driven spindles.

5. The boat propulsion system as claimed in claim 4, wherein the pumps mounted on the front and right side of the bottom of the boat are able to connect with gears and the driven spindles respectively.

6. The boat propulsion system as claimed in claim 5, the pumps are arranged in four sets, wherein two of the pumps are mounted on a fore and an aft bottom of the boat in which the outlet of the froe pump positioned toward the front of the boat and the outlet of the aft pump positioned toward the rear of the boat, another two of the pumps mounted respectively on a left and a right side of the boat.

7. The boat propulsion system as claimed in claim 6, wherein the pump mounted on the left side of the boat is preferably positioned over mid bottom.

8. A boat propulsion system mounted on a boat and being replaceable to a rudder, comprising:

a plurality of positive displacement pumps which having high discharge head and mounted on a bottom of the boat and driven by a motive power, each pump comprising a housing having a driving chamber, an inlet and an outlet, wherein a first gear rotor and a second gear rotor which are assembled in the driving chamber and being engaged with each other, each outlet of the pumps disposed on different positions according to moving directions of the boat; and a controlling panel set on the boat having circuits for switching on or off each pump, wherein the pumps are able to shift speeds and directions for controlling the movement of the boat.

* * * * *